US007731060B2

(12) United States Patent
Jones

(10) Patent No.: US 7,731,060 B2
(45) Date of Patent: Jun. 8, 2010

(54) OUTLET TAP ASSEMBLY FOR A LIQUID FILLED FLEXIBLE PACKAGING BAG

(75) Inventor: Ronald Archibald Jones, Stellenbosch (ZA)

(73) Assignee: Tap-It Liquid Solutions (Proprietary) Limited, Stellenbosch (ZA)

( * ) Notice: Subject to any disclaimer, the term of this patent is extended or adjusted under 35 U.S.C. 154(b) by 743 days.

(21) Appl. No.: 10/592,695

(22) PCT Filed: Mar. 8, 2005

(86) PCT No.: PCT/IB2005/000579

§ 371 (c)(1),
(2), (4) Date: Sep. 12, 2006

(87) PCT Pub. No.: WO2005/092779

PCT Pub. Date: Oct. 6, 2005

(65) Prior Publication Data

US 2008/0142543 A1 Jun. 19, 2008

(30) Foreign Application Priority Data

Mar. 23, 2004 (ZA) ..... 2004/2244

(51) Int. Cl.
*B67D 1/00* (2006.01)

(52) U.S. Cl. ..... 222/81; 222/105

(58) Field of Classification Search ..... 222/80, 222/81, 82, 83, 83.5, 85, 86, 87, 88, 89, 90, 222/91, 105

See application file for complete search history.

(56) References Cited

U.S. PATENT DOCUMENTS 2,267,159 A 12/1941 Lopes, Jr.

(Continued)

FOREIGN PATENT DOCUMENTS

DE 26 56 486 6/1978

(Continued)

OTHER PUBLICATIONS

International Preliminary Repot on Patentability for PCT Application No. PCT/IB2005/000579, mailed Sep. 26, 2006.

(Continued)

*Primary Examiner*—Kevin P Shaver
*Assistant Examiner*—Jonathan Wood
(74) *Attorney, Agent, or Firm*—Meyertons, Hood, Kivlin, Kowert & Goetzel, P.C.; Eric B. Meyertons

(57) ABSTRACT

An outlet tap assembly (1) for dispensing liquid packaged in flexible packaging bags is provided. The tap assembly comprises a tubular outlet member (2, 32) having a bore (8) therein, a tap (5, 6) at one end for controlling the flow of liquid through the bore, and a spike (3) at the opposite end for penetrating a plastic packaging bag. At least one aperture (4) communicates with the bore towards the inner end to allow liquid to enter from a bag into the bore. An endless clamping surface (11, 31) encircles the outlet member between the aperture and tap and a clamping element (12, 30, 35) having an endless clamping edge or surface (13) is movable axially on the outlet member so as to cooperate with the clamping surface on the outlet member to operatively clamp material of a flexible packaging bag therebetween. The outlet tap assembly has resilient means (16, 21, 26, 29, 33, 36) for urging the clamping element axially into engagement with the clamping surface on the outlet member automatically.

6 Claims, 4 Drawing Sheets

U.S. PATENT DOCUMENTS

| | | | | |
|---|---|---|---|---|
| 2,585,801 | A * | 2/1952 | Lieuwen | 222/90 |
| 3,060,446 | A | 10/1962 | Horne | |
| 3,239,104 | A | 3/1966 | Scholle | |
| 3,762,606 | A | 10/1973 | Lande | |
| 4,494,674 | A | 1/1985 | Roof | |
| 6,223,954 | B1 * | 5/2001 | Carow | 222/321.7 |
| 6,554,164 | B1 * | 4/2003 | Jones | 222/81 |

FOREIGN PATENT DOCUMENTS

| | | |
|---|---|---|
| DE | 2656486 | 6/1978 |
| GB | 2 136 781 | 9/1984 |
| GB | 2136781 | 9/1984 |
| NL | 1 016 534 | 5/2002 |
| NL | 1016534 | 5/2002 |
| WO | WO 92/17374 | 10/1992 |
| WO | WO 01/00503 | 1/2001 |
| WO | WO 03/070593 | 8/2003 |

OTHER PUBLICATIONS

International Search Report for PCT Application No. PCT/IB2003/000556, mailed May 26, 2004.

International Search Report for PCT Application No. PCT/ZA00/00116, mailed Nov. 7, 2000.

* cited by examiner

OUTLET TAP ASSEMBLY FOR A LIQUID FILLED FLEXIBLE PACKAGING BAG

FIELD OF THE INVENTION

This invention relates to an outlet tap assembly for a liquid filled flexible packaging bag from which the liquid content is to be drawn off from time to time on demand. The outlet tap may be configured to be used in association with the well-known bag-in-box type of packaging; liquid filled flexible packaging bags that are to be used in drinking water fountains, or in reusable boxes or other containers such as those described in international patent publication no WO 01/00504 entitled "FLEXIBLE PACKAGING BAG AND SUPPORT UNIT" or international patent publication no WO 02/092462 entitled "A BOX FOR A LIQUID FILLED PACKAGING BAG".

Still more particularly, the invention relates to an outlet tap assembly of the general type described in international patent publication no WO 01/00503 entitled "LIQUID PACKAGING SYSTEM AND COMPONENTS THEREOF" in which a tap is located at one end of a tubular outlet member that has a spike at its opposite end for penetrating a flexible wall of a liquid filled flexible packaging bag by piercing the material and causing it to deform onto the outer surface of the outlet member. The outlet member has a lateral aperture communicating with the bore of the tubular spike towards an inner end region of the outlet member so that liquid may enter the bore of the outlet member, in use. The tap is then used to control the flow of liquid through the tubular outlet member from the interior of the flexible packaging bag.

It is to be noted that the description contained in the published international patent publications identified above is incorporated herein by reference.

BACKGROUND TO THE INVENTION

In instances in which a spiked tubular outlet associated with a tap has entered a flexible packaging bag as indicated above, applicant considers it to be desirable to lock the flexible packaging bag material onto the outer surface of the tubular outlet member. To this end, there has been proposed a clamping sleeve that cooperates with a slightly enlarged region of the outer surface of the outlet member so that a doubled over ring of the plastics material of the packaging bag is clamped firmly onto the outer surface of the outlet member.

For this purpose, there is proposed, in international patent publication no WO 03/070593, manually engagable co-operating formations on a tap and tubular outlet unit on the one hand and a clamping sleeve on the other. These formations are typically of a bayonet and socket type of construction so that manual manipulation of the sleeve relative to the tap and tubular outlet unit causes axial movement of the sleeve on the tubular outlet and consequent clamping of the plastic material.

Whilst the latter operates effectively in use, there is always the danger that a user will fail to engage the sleeve correctly, will even fail to take steps to engage it at all, and that could, in turn, result in the clamping being ineffective. Also, in the common instance that the sleeve carries a mounting flange arrangement, the tap could be loose relative to the mounting flange if the formations become, or remain, disengaged.

It is to be understood that the term liquid as used in this specification is intended to include semi-liquids such as those that may flow rather slowly or only with some encouragement as, for example, by a slightly elevated pressure being exerted on the outside of the flexible packaging bag. Typical of such semi-liquids are food condiments such as sauces, mayonnaise, concentrated fruit and vegetable juices, high viscosity oils, etc.

OBJECT OF THE INVENTION

It is accordingly an object of this invention to provide an outlet tap assembly having an alternative clamping arrangement to those described above and one that requires less activity on the part of a user during installation.

SUMMARY OF THE INVENTION

In accordance with this invention there is provided an outlet tap assembly comprising a tubular outlet member having a bore therein, a tap at one end (operatively the outer end and hereinafter referred to as such) for controlling the flow of liquid through the bore, and a spike at the opposite end (operatively the inner end and hereinafter referred to such), at least one aperture communicating with the bore towards the inner end, an endless clamping surface encircling the outlet member between the aperture and tap; and a clamping element movable axially on the outlet member and having an endless clamping edge or surface for cooperation with the clamping surface on the outlet member to operatively clamp material of a flexible packaging bag therebetween; the outlet tap assembly being characterized in that resilient means are provided for urging the clamping element axially into engagement with the clamping surface on the outlet member such that the clamping element may move away from the clamping surface against the action of the resilient means during installation and automatically become operative under the action of the resilient means thereafter.

Further features of the invention provide for the clamping surface to be formed between the outer surface of a portion of the outlet member communicating with the tap and an enlarged portion towards the inner end of the outlet member; for the clamping element to include a flat platelike portion, typically of the general nature of a disc, having a central aperture the periphery of which is configured to define a clamping surface of the clamping element; for the resilient means to act between the clamping element and a mounting flange adapted for mounting the tap relative to a box containing a flexible packaging bag in association with which the tap assembly is to be used; and for the mounting flange to be formed integral with the outlet member and to be preferably comprised of a pair of spaced flanges adapted to accommodate edges of an aperture in a wall between them in order to locate the tap relative to the wall.

The resilient means may assume numerous different forms and, in particular, may be a plastics platelike element, typically of the general form of a disc, with which there are formed integral a plurality of equally angularly spaced resilient arms that extend towards a mounting flange on the outlet member and that are adapted to flex resiliently to allow movement of the clamping member away from the clamping surface on the outlet member during installation of the tap but that automatically return the clamping member to its operative position thereafter. Preferably, in such an instance, the resilient arms are attached to the plastics element by means of integral hinges so that they may extend rearwards at generally right angles to the platelike element and follow an operatively arcuate or sinuous path that provides the necessary axial resiliency. The free ends of the resilient arms are preferably provided with journal formations that clip into co-operating formations formed integral with the mounting flange or outlet member.

Alternatively, the resilient means may be composed of a separate element such as a helical, in particular a truncated conical shape, spring or even a simple resilient tubular sleeve, such as one of a closed cell foam material installed between the clamping member and mounting flange, for example.

Of course, in all cases, the mounting flange may simply be replaced by a suitable stop formed on the outlet member for the purpose of cooperation with the resilient means in the event that no mounting flange is required.

In order that the above and other features of the invention may become more apparent various different embodiments will now be described with reference to the accompanying drawings.

DETAILED DESCRIPTION WITH REFERENCE TO THE DRAWINGS

Figure 1:
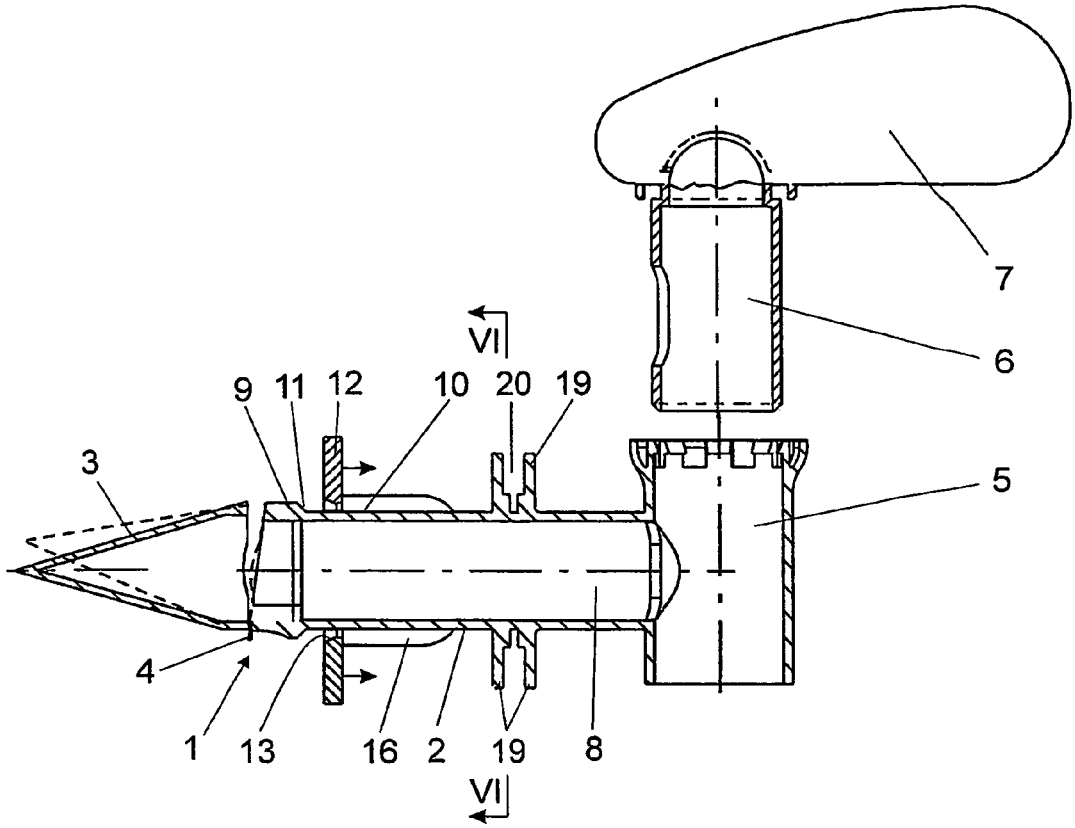
FIG. 1 is a schematic sectional elevation of one form of tap assembly according to the invention with the tap closure in exploded relationship relative to the tap body and the clamping element moved away from the clamping surface against the resilient biasing thereof for illustrative purposes.
Figure 2:
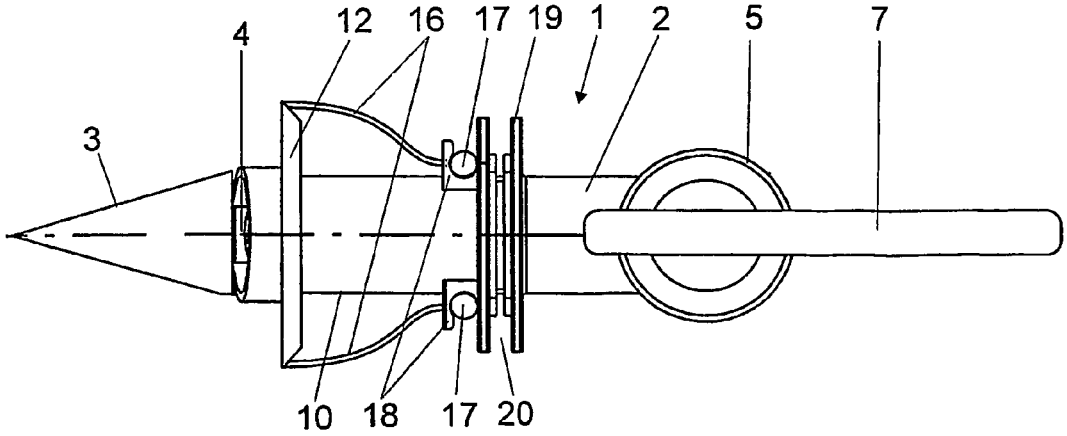
FIG. 2 is a plan view thereof with the clamping element in its normal position against the clamping surface.
Figure 3:
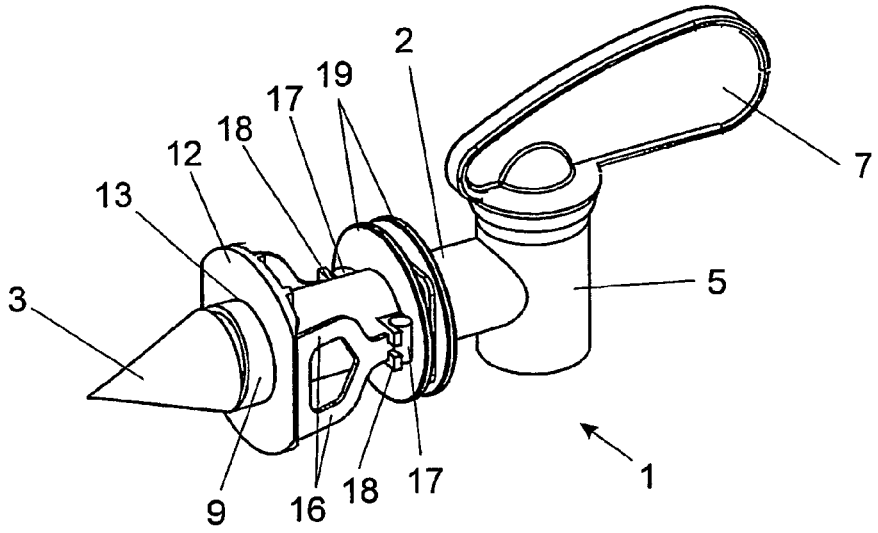
FIG. 3 is a perspective view of the tap assembly illustrated in FIGS. 1 and 2.

In the embodiment of the invention illustrated in FIGS. 1 to 6, an outlet tap assembly, generally indicated by numeral (1), includes a tubular outlet member (2) of circular shape in cross-section, with a spike (3) of generally coaxial right circular conical shape formed coaxially at one end, the operatively inner end and herein termed the inner end. The spiked conical end is attached to the tubular outlet member by way of an integral hinge (4) so that, for installation purposes, it can hinge to the position illustrated in ghosted lines in FIG. 1 in which the outlet is closed during penetration of a flexible plastic bag, whereafter it automatically opens to the condition illustrated in solid lines.

The other end of the outlet member, herein termed the outer end, has formed integral with it an operatively vertical transverse tubular tap body (5) that receives a relatively rotatable tubular closure member (6) of generally known type and that can be rotated by means of a finger grip (7) in order to move it angularly into and out of registration with the bore (8) of the outlet member in order to open and close the tap.

It will be understood that the outlet member is such that the spike can be introduced through the wall of a flexible packaging bag of liquid with the hingeing effect taking place as described above and as more fully described in international patent application WO 01/00503.

The tubular outlet member has a slightly radially enlarged zone (9) adjacent the spike end that communicates with the outer surface (10) of the remainder of the tubular member through an endless clamping surface (11) encircling the outlet member, very much along the lines indicated in said earlier application WO 01/00503. The clamping surface is typically of a simple truncated conical shape.

Axially slidable on the outlet member is a plate-like clamping element in the general form of a disc (12) with a central hole (13) the periphery of which defines the clamping surface of the clamping element that is adapted to cooperate with the clamping surface (11) on the tubular outlet member. The dimensions of the central hole (13) defining the clamping surface of the clamping element are selected such that it is a press fit over the enlarged zone (9) of the tubular outlet member such that once installed, the clamping element is held substantially captive on the outlet member. The clamping element is orientated such that the endless clamping surface (13) is directed for cooperation with the clamping surface (11) encircling the outlet member.

Formed integral with the clamping element, and connected to it through integral hinges (14) that extend along two diametrically opposite and parallel cords of the generally disc shaped element, are two operatively rearwardly extending, resilient arm assemblies (15). Each of the resilient arm assemblies has a pair of spaced arms (16) extending away from the clamping element itself and converging to terminate in an integral journal formation (17) of right circular cylindrical shape. Each of the journals (17) is operatively received and clipped into clip formations (18) formed integral with a mounting flange arrangement comprising a pair of spaced flanges (19) defining a surrounding groove (20) between them for receiving an edge of an aperture in the wall of a box (not shown) in which a liquid packaging bag is to be stored in well known manner. In particular, the mounting bracket could be adapted for use in combination with a box as described in international patent applications numbers WO 01/00504 or WO 02/092462.

Figure 4:
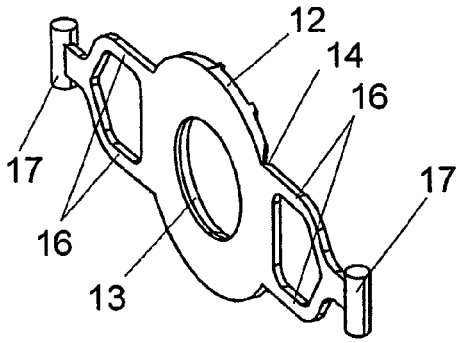
FIG. 4 is a perspective view of the clamping member and associated integral arm assembly from the side that is operatively directed towards the spike end of the body.
Figure 5:
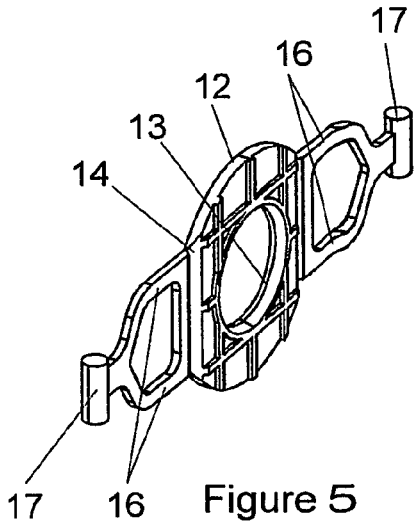
FIG. 5 is a perspective view of the clamping member and associated integral arm assembly from the other side that is operatively directed towards the tap end of the body.
Figure 6:
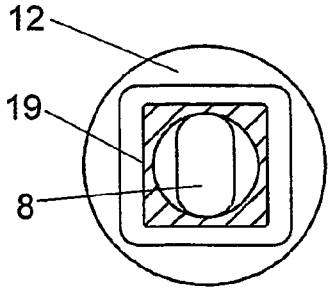
FIG. 6 is a cross-section taken along line VI-VI in FIG. 1.

The clamping element and associated resilient arm assemblies are injection moulded from plastics material separately from the body and are moulded in a flat configuration and as illustrated clearly in FIGS. 4 and 5. The arm assemblies are then hinged around the integral hinges (14) to assume the position illustrated in FIGS. 2 and 3 and, once the journals are clipped in position, the arms assume a somewhat arcuate or sinuous configuration as shown most clearly in FIG. 2 in which the clamping element is urged into firm engagement with the clamping surface (11) on the outlet tube of the tap body.

It will be understood that, in operation, the disc of the clamping member will be forced towards the mounting flange assembly against the resilient biasing of the arm assemblies thereof during installation of the tap in a flexible packaging bag to allow for the necessary penetration of the bag to take place. Once the material of the packaging bag surrounding the outlet member reaches the clamping surface on the outlet member the outlet member may be moved axially outwards so that the clamping element automatically moves towards the clamping surface under the action of the bias thereof to automatically engage and clamp the plastics material to the clamping surface (11) on the tubular tap body.

A highly effective seal is thereby achieved automatically in a simple and substantially foolproof manner. Also by appropriate selection of plastics materials from which the various components are manufactured, and by the design of the clamping surfaces, the arrangement can accommodate any normal fluctuations or differences in thickness of materials of different packaging bags.

Numerous variations can be made to the embodiment of the invention described above without departing from the scope hereof. A few possible variations will now be described.

Figure 7:
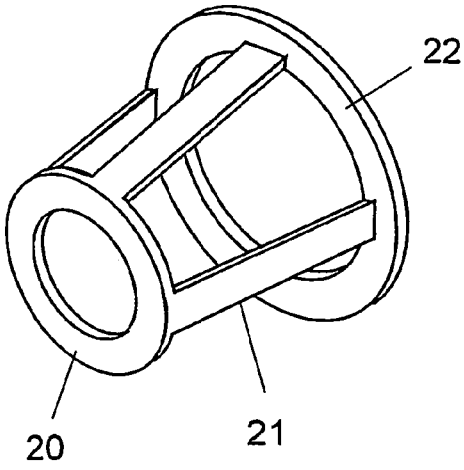
FIG. 7 is a front elevation of an alternative clamping member and associated integral arm assembly.

In the variation of the invention illustrated in FIG. 7 a clamping element (20) is in the form of a disc having a plurality of equally angularly spaced integral arms (21) extending towards an integral ring (22) so that the entire clamping element assembly is of basically truncated conical shape. The arrangement is such that the ring and disc can be moved towards each other against a resilient biasing action of the arms and return the clamping member to its operative position as a result of the resilient action of the arms subsequently. The ring, in use, engages a formation fixed relative to the tubular outlet member such as, for example, the mounting flanges described with reference to FIGS. 1 to 6.

Figure 8:
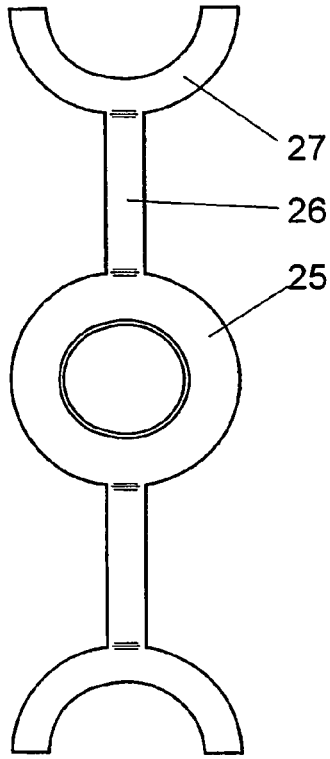
FIG. 8 is a front elevation of the a further alternative clamping member and associated integral arm assembly.

In another variation of the invention that is illustrated in FIG. 8, a similar arrangement is provided except that the clamping element assembly is made as a single flat piece, generally a flat moulding, comprising a central disc (25), a pair of diametrically opposite diverging arms (26) and a pair of semicircular rings (27), one at each free end of each arm. The rings have clipping formations (not shown) whereby they can be clipped together to form a complete ring of the type described above with the two arms assuming a generally arched resiliently biased configuration.

Figure 9:
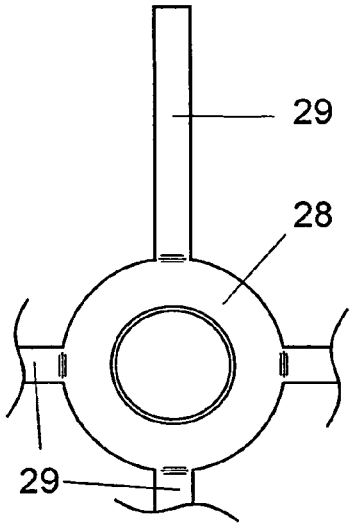
FIG. 9 is a front elevation of a still further alternative clamping member and associated integral arm assembly.

In the case of the variation illustrated in FIG. 9, the central disc (28) has four equally angularly spaced arms (29) that can be individually clipped to the mounting flange itself with the arms in an arched resiliently biased condition.

Figure 10:
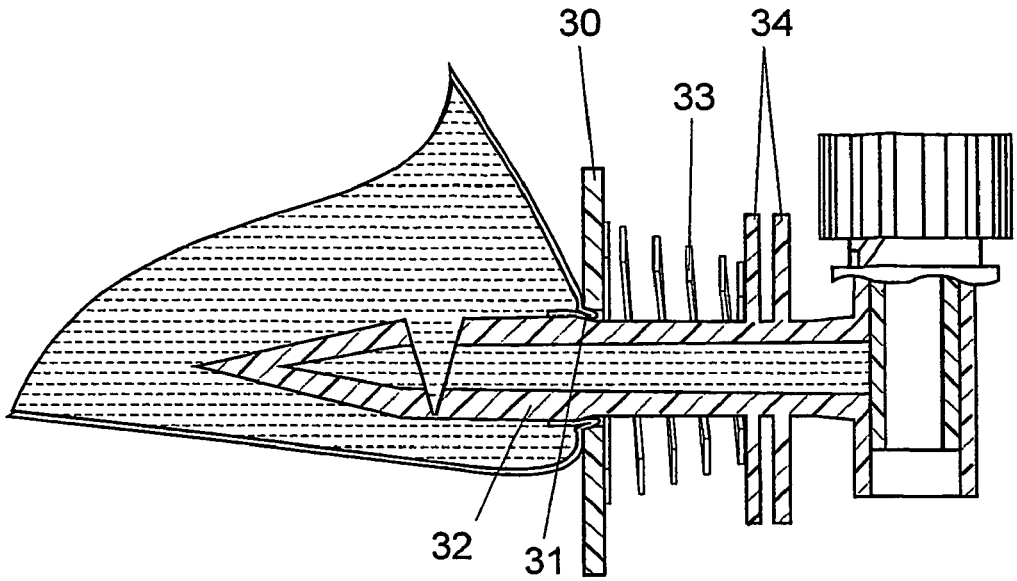
FIG. 10 illustrates a further embodiment of resilient means and also shows the installed condition generally of a tap assembly of the general type under consideration; and, FIG. 11 is a view similar to FIG. 10 illustrating a further embodiment of resilient means for implementing the invention.

In the case of the embodiment of the invention illustrated in FIG. 10, the clamping member is in the form of a simple disc (30) that is urged into engagement with the clamping surface (31) of the outlet member (32) by a helical spring (33) installed between the clamping member and a mounting flange (34). The helical spring can be of a truncated conical configuration to facilitate its collapsing to a substantially flat condition, as may be required in order to optimize design considerations.

Figure 11:
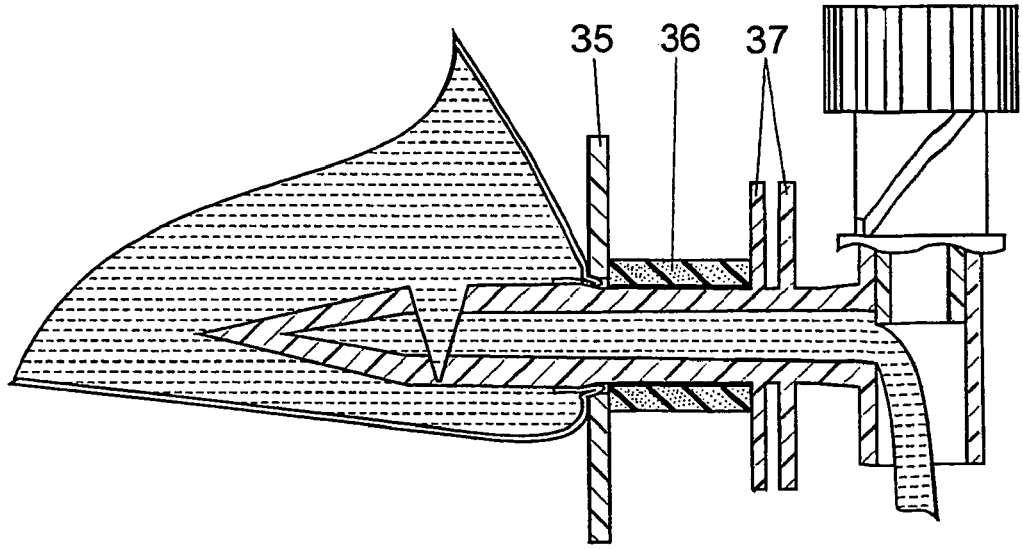

In the case of the embodiment of the invention illustrated in FIG. 11, the clamping member is again formed as a simple disc (35) urged to its operative position by means of an elastomeric sleeve (36) installed between the disc and a mounting flange (37). The sleeve can conveniently be a closed cell plastics foam.

Numerous other arrangements are possible within the scope of the invention as will be quite apparent to those skilled in the art. Also, whilst plastics materials are mentioned above it will be quite clear that other materials such as metal could equally well be used in particular in instances in which sterilization is required.

The invention claimed is:

1. An outlet tap assembly comprising a tubular outlet member having a bore therein, a tap at one end, operatively the outer end, for controlling the flow of liquid through the bore, and a spike at the opposite end, operatively the inner end, at least one aperture communicating with the bore towards the inner end, an endless clamping surface encircling the outlet member between the aperture and tap; and a clamping element movable axially on the outlet member and having a hole defining an endless clamping edge or surface for cooperation with the clamping surface on the outlet member to operatively clamp material of a flexible packaging bag therebetween;

wherein the hole defines the clamping surface of the clamping element such that it is a press fit over an enlarged zone of the tubular outlet member such that once installed, the clamping element is held substantially captive on the outlet member; and wherein resilient means are provided for urging the clamping element axially into engagement with the clamping surface on the outlet member such that the clamping element may move away from the clamping surface against the action of the resilient means during installation and automatically become operative under the action of the resilient means thereafter, the resilient means being in the form of operatively rearwardly extending resilient arm assemblies formed integral with the clamping element at one end of the arm assemblies and connected to it through integral hinges with the resilient arms having opposite free ends provided with formations that clip into co-operating formations formed integral with the outlet member.

2. An outlet tap assembly as claimed in claim 1, in which the clamping surface encircling the outlet member is formed between the outer surface of a portion of the outlet member communicating with the tap and an enlarged portion towards the inner end thereof.

3. An outlet tap assembly as claimed in claim 1, in which the clamping element includes a flat plate-like portion having the hole periphery of which is defines the clamping surface of the clamping element.

4. An outlet tap assembly as claimed in claim 1, in which the resilient means acts between the clamping element and a mounting flange adapted for mounting the tap relative to a box containing a flexible packaging bag in association with which the tap assembly is to be used, the mounting flange being formed integral with the outlet member.

5. An outlet tap assembly as claimed in claim 4 in which the mounting flange is composed of a pair of spaced flanges adapted to accommodate edges of an aperture in a wall between them in order to locate the tap relative to the wall.

6. An outlet tap assembly as claimed in claim 1 in which the formations provided on the free ends of the resilient arms are journal formations that clip into the co-operating formations formed integral with the outlet member.

* * * * *

UNITED STATES PATENT AND TRADEMARK OFFICE

CERTIFICATE OF CORRECTION

PATENT NO. : 7,731,060 B2
APPLICATION NO. : 10/592695
DATED : June 8, 2010
INVENTOR(S) : Ronald Archibald Jones It is certified that error appears in the above-identified patent and that said Letters Patent is hereby corrected as shown below:

Claim 3, col. 6, line 42, please delete "the hole periphery" and substitute therefor -- the hole, the periphery --.

Signed and Sealed this

Third Day of August, 2010

David J. Kappos

David J. Kappos
*Director of the United States Patent and Trademark Office*